United States Patent [19]

Hasegawa

[11] 4,051,882

[45] Oct. 4, 1977

[54] METHOD OF PROCESSING UNDRIED VENEER SHEET

[75] Inventor: Katsuji Hasegawa, Nagoya, Japan

[73] Assignee: Meinan Machinery Works, Inc., Ohbu, Japan

[21] Appl. No.: 667,848

[22] Filed: Mar. 17, 1976

[51] Int. Cl.[2] ..... B27M 1/02

[52] U.S. Cl. ..... 144/309 D; 34/12; 144/2 R; 144/242 R; 144/246 R; 144/320 A

[58] Field of Search ..... 34/12, 70; 144/309 R, 144/2 R, 309 D, 320, 246, 247, 248, 249, 250, 242 R; 156/555

[56] References Cited

U.S. PATENT DOCUMENTS 3,927,705 12/1975 Cromeens et al. ..... 144/309 L X

*Primary Examiner*—Othell M. Simpson
*Assistant Examiner*—W. D. Bray
*Attorney, Agent, or Firm*—Blanchard, Flynn, Thiel, Boutell & Tanis

[57] ABSTRACT

An undried veneer sheet is fed in a direction substantially against the grain of the veneer sheet by means of an infeed conveyor means having a predetermined feeding speed and an outfeed conveyor means having a feeding speed lower than the predetermined feeding speed to compress the undried veneer sheet for efficiently dehydrating same without affecting sheet thickness since compression is not applied against the thickness of the veneer sheet. This invention also serves to cause the water content in the veneer sheet to be relatively uniform after processing due to the fact that the method of compression utilizes the difference in feeding speed between the infeed and outfeed conveyor means. As a result, the water content of the processed veneer sheet in the final drying process is made uniform and the controlling of the water content in the veneer sheet is remarkably simplified.

5 Claims, 8 Drawing Figures

METHOD OF PROCESSING UNDRIED VENEER SHEET

The present invention relates to a method of processing an undried veneer sheet, namely, an unseasoned veneer sheet, containing a considerable amount of water.

The conventional method for extracting water contained in an undried veneer sheet consists of mechanically compressing the undried veneer sheet with a pair of rolls from both sides of the sheet and it involves deformation of the sheet in the thickness direction. This method had the following problems.

As shown in FIG. 1 which will be explained later, a veneer sheet normally has pith rays 25 extending in the direction of the sheet thickness and these pith rays 25 play an important role in the strength of the veneer sheet in the thickness direction. If the veneer sheet is excessively compressed in the thickness direction for the purpose of extracting water, the pith rays 25 are destroyed thereby causing the veneer sheet to become too thin and too weak to be used for manufacturing good plywood.

An object of the present invention, therefore, is to eliminate the above drawback of the conventional method of excessively compressing an unseasoned veneer sheet and to save the cost and labor by simplifying the final drying process of the veneer sheet.

Another object of the present invention is to speed up the drying process of a veneer sheet by substantially eliminating the water content from the veneer sheet by compressing it in the direction against the grain, thus breaking tubular membranes present inside the veneer sheet to improve its air-permeability.

According to the present invention, there is provided a method of processing an undried veneer sheet comprising the steps of feeding an undried veneer sheet at a predetermined feeding speed in a direction substantially against the grain of the veneer sheet by use of an infeed conveyor means having a predetermined feeding speed and an outfeed conveyor having a feeding speed lower than the predetermined feeding speed, whereby the undried veneer sheet is continuously compressed, while being fed, in the direction substantially against the grain of the veneer sheet due to the difference in the feeding speed between the infeed and the outfeed conveyor means.

In the attached drawings the present invention is explained further in detail;

Figure 1:
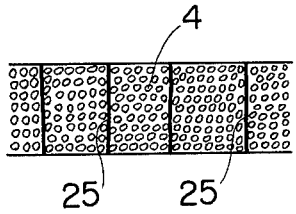
FIG. 1 shows an enlarged sectional view of a veneer sheet.
Figure 2:
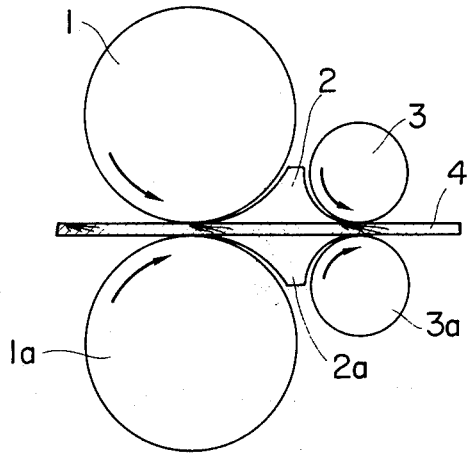
FIG. 2 shows a side view of one embodiment of the present invention.

Referring now to FIG. 2, 1 and 1*a* designate a pair of upper and lower rolls used as the infeed conveyor means. Likewise, 3 and 3*a* are a pair of upper and lower rolls used as the outfeed conveyor means. The rolls 1 and 1*a* are driven at a somewhat higher peripheral speed than the rolls 3 and 3*a*. 2 and 2*a* designate veneer sheet guides provided along the path of a veneer sheet 4 and between the infeed rolls 1, 1*a* and the outfeed rolls 3, 3*a*, in order to prevent the veneer sheet from buckling while being compressed. The veneer sheet 4 fed therethrough is conveyed at the peripheral speed of the rolls 1 and 1*a* while passing the position thereof and at the peripheral speed of the rolls 3 and 3*a*, which is lower than the peripheral speed of the rolls 1 and 1*a*, while passing the position of the rolls 3 and 3*a*. Therefore, the veneer sheet 4 coming between the rolls 1 and 1*a* and the rolls 3 and 3*a* is compressed in one direction of feed, namely in a direction substantially against the grain of the veneer sheet due to the difference in peripheral speed between the rolls 1 and 1*a* and the rolls 3 and 3*a*.

The compressing force is proportional to the pressing force applied by the rolls 1 and 1*a* against the veneer sheet and to the coefficient of friction between the rolls and the veneer sheet. However, in order to minimize the strain of the veneer sheet which might be caused by the pressing force in the direction of its thickness while maintaining the feeding and compressing performance by the rolls, it is necessary to increase the coefficient of friction by making the diameter of each roll larger and roughening the surface thereof.

Figure 3:
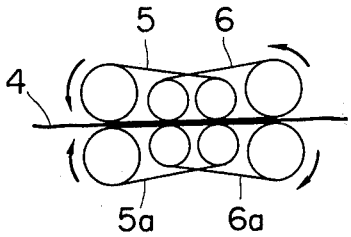
FIG. 3 shows a side view of another embodiment of the present invention.

FIG. 3 shows another embodiment in which a plurality of infeed belt conveyors 5 and 5*a* having a predetermined feeding speed and a plurality of outfeed belt conveyors 6 and 6*a* having a feeding speed slower than the predetermined feeding speed of the infeed belt conveyors 5 and 5*a* are provided alternately in the transverse direction and the veneer sheet 4 is compressed in the direction of feed due to the difference in feeding speeds between the faster conveyors 5 and 5*a* and the slower conveyors 6 and 6*a*.

Figure 4:
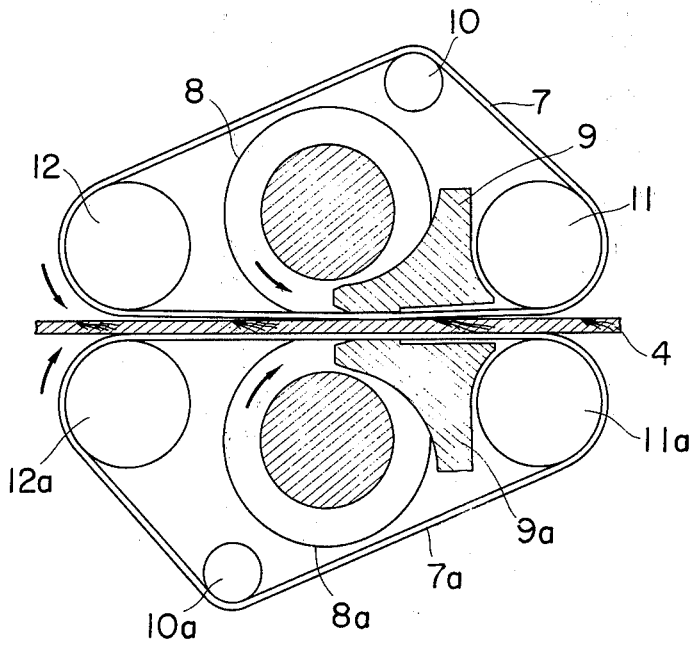
FIG. 4 shows a side view of a further embodiment of the present invention.
Figure 5:
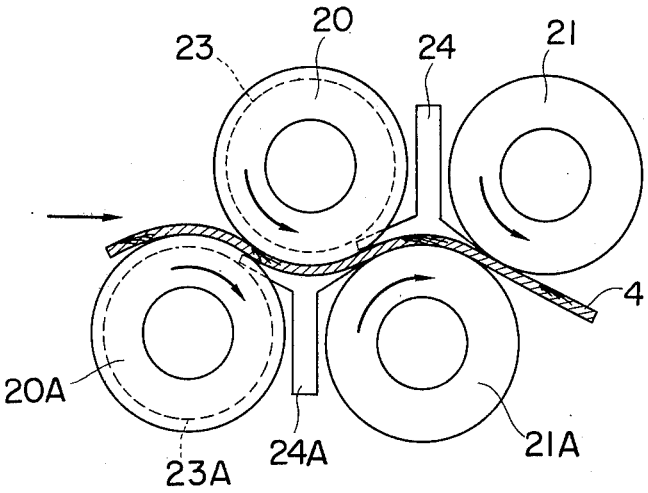
FIG. 5 shows a side view of a still further embodiment of the present invention.
Figure 6:
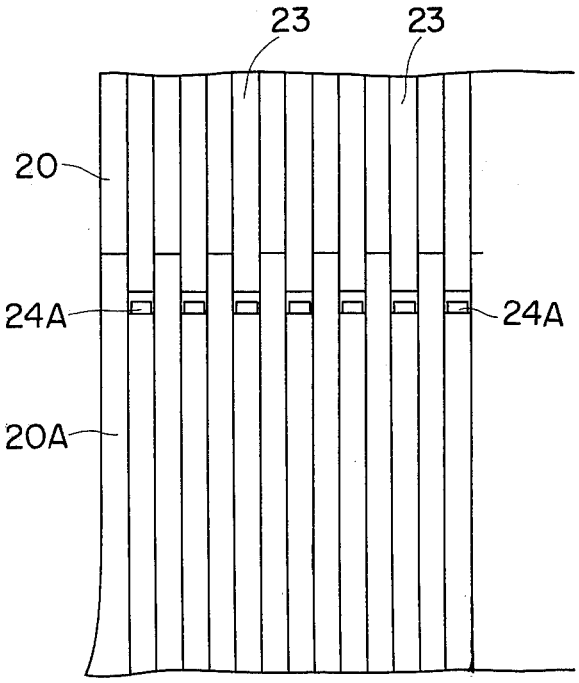
FIG. 6 shows a front view of the embodiment shown in FIG. 5 viewed from the infeed side.

In the embodiment shown in FIG. 4, a pair of rolls 8 and 8*a* are used as the infeed conveyor means, while a plurality of belt conveyors 7 and 7*a*, in the form of chains or belts, are employed as the outfeed conveyor means. A plurality of appropriately spaced circular grooves (not shown) are provided on the rolls 8 and 8*a* and the belt conveyors 7 and 7*a* are made to travel on the circular grooves. Pressing members 9 and 9*a* are provided at a position slightly on the outfeed side of the pair of rolls 8 and 8*a* and are adapted to clamp the belt conveyors 7 and 7*a* to the extent that the belt conveyors 7 and 7*a* may have a proper force for feeding the veneer sheet. It goes without saying that the feeding speed of the rolls 8 and 8*a* is higher than that of the belt conveyors 7 and 7*a*. Rolls 10, 11 and 12 are provided for supporting the belt conveyor 7, and rolls 10*a*, 11*a* and 12 are provided for supporting the belt conveyor 7*a*. Since the infeed and outfeed conveyor means in this embodiment are placed closely to each other, it is possible to apply satisfactory compression to the entire veneer sheet and to perform uniform compression. Even in a case where the veneer sheet contains cracks, holes etc. which are apt to make the strength in the direction of feed uneven, such uniform compression is possible in this embodiment.

Figure 7:
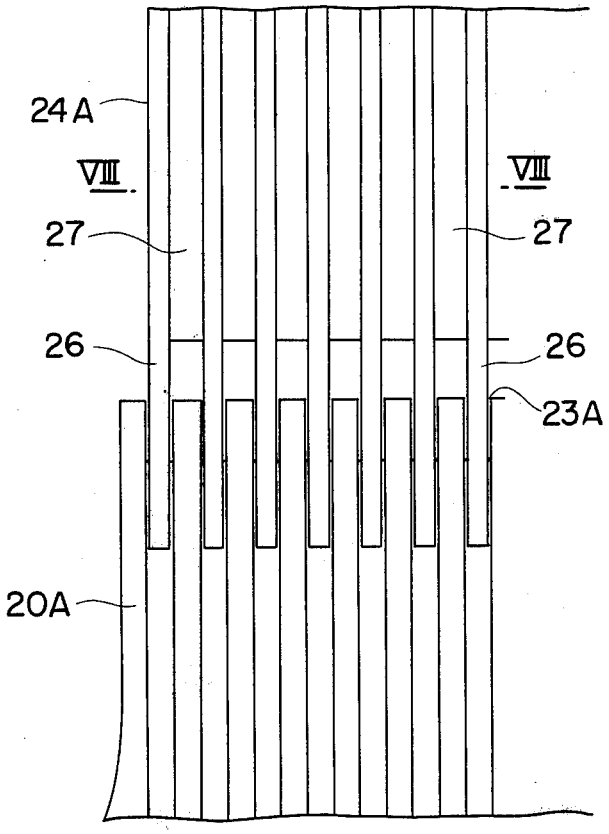
FIG. 7 shows a partial plan view of a roll 20A and a veneer sheet guide 24A shown in FIG. 5 with a roll 20 removed.
Figure 8:
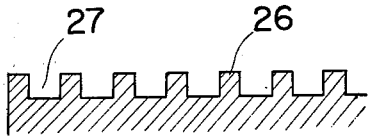
FIG. 8 shows a sectional view of the veneer sheet guide 24A taken along the line VIII — VIII of FIG. 7.

In a further embodiment as shown in FIGS. 5 through 8, infeed rolls 20 and 20A and outfeed rolls 21 and 21A are provided in such a way that the upper rolls of the respective pairs are in staggered positions with respect to the lower rolls of the respective pairs. The rolls 20 and 20A are driven at a higher peripheral speed than the rolls 21 and 21A. A plurality of grooves 23 and 23A are provided in the direction of rotation on the peripheral surfaces of the rolls 20 and 20A and first veneer sheet guide 24 and second veneer sheet guide 24A are provided between the rolls 20 and 21 and the rolls 20A and 21A, respectively. The faces of veneer sheet guides 24 and 24A are arc-shaped for the purpose of guiding veneer sheet 4 to proceed along the surfaces of rolls 20 and 21A. Each arc-shaped veneer sheet guide 24 and 24A has a comb-like teeth on the infeed side as shown in FIG. 7 and the comb-like teeth 26 are made to engage in the grooves 23 and 23A provided on rolls 20 and 20A. The comb-like teeth of the veneer sheet guides 24 and 24A contain grooves 27 between each tooth base of the comb-like teeth. When veneer sheet 4 is fed from the infeed side, the veneer sheet 4 is continuously compressed in the same feed direction, due to the difference in feeding spaced between rolls 20 and 20A and rolls 21 and 21A, pressing the water content out of the veneer sheet 4. In this embodiment, the veneer sheet 4 is pressed against the rolls 20 and 21A, respectively, by the arc-shaped veneer sheet guides 24A and 24. As a result, a large portion of the surface of the veneer sheet 4 contacts the rolls 20 and 21A, enhancing the feeding force of the rolls 20 and 21A. Hence water contained in the veneer sheet 4 is effectively compressed out. On the other hand, since the pressing force applied in the direction of thickness of the veneer sheet 4 is allowed to be less than in the case of the embodiment shown in FIG. 2, the veneer sheet 4 is more effectively prevented from being destroyed in the direction of thickness.

In this manner, the present invention is directed for compressing an undried veneer sheet, while same is being fed by means of a faster infeed conveyor means and a slower outfeed conveyor means substantially in the feed direction of the veneer sheet. Since compression is not accomplished in the direction of thickness of the veneer sheet, the compression does not reduce the thickness of the veneer sheet. Also, since the Young's modulus of the veneer sheet peeled off by a veneer lathe is least in the feed direction of the veneer sheet, the present invention facilitates compression and allows the veneer sheet to regain practically all of its original length after compression is carried out. Besides making efficient dehydration of veneer sheets possible, the present invention, utilized for dehydrating undried veneer sheets utilizing the difference in feeding speed between the infeed and outfeed conveyor means, causes the water content in the veneer sheets to be relatively uniform after processing of the veneer sheets. As a result, the final drying process is remarkably simplified and the controlling of the water content in the veneer sheet is uniform.

According to the results of experiments, properly compressed veneer sheets can be dried more rapidly than uncompressed veneer sheets which is also due to factors other than the amount of water eliminated by dehydration. For example, breakage of tubular membranes containing water facilitates evaporation of this water. One of the test results shows that a compression of about 30% results in a reduction of time needed for drying by 20% – 30% making it possible to speed up the conventional drying process, thus serving to improve the heat drying efficiency.

What is claimed is:

1. A method of processing an undried wood veneer sheet in order to reduce the water content of said sheet and improve its dry-ability, which comprises the steps of: continuously moving said undried veneer sheet in a direction against the grain of said sheet by drivingly contacting the opposite surfaces of said sheet by infeed conveyor elements which are continuously moving at a first predetermined speed in said direction and simultaneously drivingly contacting the opposite surfaces of said sheet by outfeed conveyor elements located at positions close to and downstream of the positions at which said infeed conveyor elements drivingly contact said sheet, said outfeed conveyor elements continuously moving in said direction at a second predetermined speed which is slower than said first predetermined speed so that a uniform compression force is continuously applied to successive portions of the sheet in the direction of movement thereof and against the grain thereof sufficient to extract water therefrom, to cause the water content of the sheet to be more uniform along the length thereof and to break tubular membranes in the veneer sheets; and simultaneously confining said opposite surfaces of the sheet against movement transverse to said direction from the time the sheet enters between said infeed conveyor elements until the time it leaves said outfeed conveyor elements to prevent the sheet from buckling.

2. A method as claimed in claim 1 in which said sheet is drivingly contacted by said infeed conveyor elements which comprise a pair of rotating, radially opposed, parallel, infeed rolls whose axes of rotation lie in a first common plane which is perpendicular to the plane of said sheet, and said sheet is thereafter drivingly contacted by said outfeed conveyor elements which comprise a pair of rotating, radially opposed, parallel, outfeed rolls whose axes of rotation lie in a second common plane which is perpendicular to the plane of said sheet and is spaced from said first common plane and is located downstream thereof, and as the sheet moves from the infeed rolls to the outfeed rolls the opposite surfaces of said sheet pass between the opposing parallel surfaces of veneer sheet guides which extend from the nip between said infeed rolls to the nip between said outfeed rolls.

3. A method as claimed in claim 1 in which said sheet is drivingly contacted by said infeed conveyor elements which comprise longitudinally moving endless infeed conveyor belts having opposed reaches for drivingly contacting the opposite surfaces of said sheet, and said sheet is thereafter contacted by said outfeed conveyor elements which comprise longitudinally moving endless outfeed conveyor belts having opposed reaches for drivingly contacting the opposite surfaces of the sheet, the reaches of said infeed conveyor belts being overlapped with the reaches of said outfeed conveyor belts in the direction of movement of the sheet so that the sheet enters between the reaches of said outfeed conveyor belts while it is still confined between the reaches of said infeed conveyor belts.

4. A method as claimed in claim 1 in which said sheet is drivingly contacted by said infeed conveyor elements which comprise a pair of rotating, radially opposed, infeed rolls whose axes of rotation lie in a first common plane which is perpendicular to the plane of said sheet, and simultaneously said sheet is confined between said outfeed conveyor elements which comprise longitudinally moving endless outfeed conveyor belts having opposed reaches disposed adjacent the opposite surfaces of the sheet, and pressing said reaches of said outfeed conveyor belts against the opposite surfaces of said sheet after said sheet has exited from the nip between said infeed rolls.

5. A method as claimed in claim 1 in which said sheet is moved between said infeed conveyor elements which comprise a pair of rotating, radially opposed, parallel, infeed rolls whose axes of rotation are offset in the direction of movement of the sheet, and said sheet is thereafter moved between said outfeed conveyor elements which comprise a pair of rotating, radially opposed, parallel, outfeed rolls whose axes of rotation are offset in the direction of movement of the sheet, and wherein the trailing infeed roll is also radially opposed to the leading outfeed roll, and pressing said sheet against the periphery of the trailing infeed roll and against the periphery of the leading outfeed rolls as the sheet moves therepast.

* * * * *